US008221632B2

(12) United States Patent
McInnis et al.

(10) Patent No.: US 8,221,632 B2
(45) Date of Patent: Jul. 17, 2012

(54) SURFACE WATER FILTRATION DEVICE

(75) Inventors: Stephen J. McInnis, Portland, OR (US); Matthew E. Moulton, Portland, OR (US)

(73) Assignee: Cleanway Environmental Partners, Inc., Portland, OR (US)

( * ) Notice: Subject to any disclaimer, the term of this patent is extended or adjusted under 35 U.S.C. 154(b) by 194 days.

(21) Appl. No.: 12/649,410

(22) Filed: Dec. 30, 2009

(65) Prior Publication Data

US 2011/0155672 A1 Jun. 30, 2011

(51) Int. Cl.
*E03F 5/06* (2006.01)
*E03F 5/16* (2006.01)

(52) U.S. Cl. ..... 210/747.3; 210/806; 210/164; 210/170.03; 210/338

(58) Field of Classification Search ..... 210/747.3, 210/806, 163, 164, 170.03, 335, 337, 338, 210/474; 404/4, 5
See application file for complete search history.

(56) References Cited

U.S. PATENT DOCUMENTS

| | | | | |
|---|---|---|---|---|
| 3,713,539 | A | 1/1973 | Thompson et al. | |
| 3,815,748 | A | 6/1974 | Johannessen | |
| 4,419,232 | A | 12/1983 | Arntyr et al. | |
| 4,988,235 | A | 1/1991 | Hurley | |
| 5,037,541 | A | 8/1991 | Ruey-Jang et al. | |
| 5,133,619 | A | 7/1992 | Murfae et al. | |
| 5,223,154 | A | 6/1993 | MacPherson, Jr. et al. | |
| 5,284,580 | A | 2/1994 | Shyh | |
| 5,345,741 | A | 9/1994 | Slater et al. | |
| 5,372,714 | A | 12/1994 | Logue, Jr. | |
| 5,397,464 | A | 3/1995 | Hannon | |
| 5,403,474 | A | 4/1995 | Emery | |
| 5,405,539 | A | 4/1995 | Schneider | |
| 5,480,254 | A | 1/1996 | Autry et al. | |
| 5,486,287 | A | 1/1996 | Murphy et al. | |
| 5,529,436 | A | 6/1996 | Meyers | |
| 5,575,925 | A | 11/1996 | Logue, Jr. | |
| 5,958,226 | A | 9/1999 | Fleischmann | |
| 5,985,157 | A | 11/1999 | Leckner et al. | |
| 6,080,307 | A | 6/2000 | Morris et al. | |
| 6,086,758 | A | 7/2000 | Schilling et al. | |
| 6,106,707 | A | 8/2000 | Morris et al. | |
| 6,200,484 | B1 | 3/2001 | McInnis | |
| 6,537,446 | B1 * | 3/2003 | Sanguinetti | 210/163 |
| 7,524,414 | B1 * | 4/2009 | Barragan | 210/163 |
| 7,658,857 | B2 * | 2/2010 | Wacome | 210/747.3 |
| 2005/0051499 | A1 * | 3/2005 | Nino | 210/163 |
| 2006/0049085 | A1 * | 3/2006 | Parker | 210/163 |
| 2008/0290042 | A1 * | 11/2008 | Hanson et al. | 210/164 |
| 2009/0101553 | A1 * | 4/2009 | Lucas | 210/164 |

* cited by examiner

*Primary Examiner* — Christopher Upton
(74) *Attorney, Agent, or Firm* — Hancock Hughey LLP

(57) ABSTRACT

A plate is positioned across an inlet to a catch basin and a filter strainer is inserted through an opening through the plate and into the basin. A tertiary filter completely surrounds the strainer and is suspended below the plate. Surface water flows through a primary grate that covers the catch basin, through the strainer and through the tertiary filter. The tertiary filter comprising fibrous filter media retained in a non-woven mesh fabric enclosure and the filter media is selected according to the type of contaminants that are to be removed.

19 Claims, 3 Drawing Sheets

SURFACE WATER FILTRATION DEVICE

FIELD OF THE INVENTION

This invention relates to a filtration apparatus for surface water, and more specifically, to a three stage filtration apparatus for removing sediment and other contaminants from surface water.

BACKGROUND

Surface water run-off is coming under increased scrutiny as a source of pollutants entering ground water, streams and rivers. As water from rain or snow melt and other sources flows over the surface of the ground it picks up a wide variety of pollutants, ranging from large and small debris, suspended solids and sediment to oils and other soluble and insoluble chemical contaminants. Because surface water is relatively easily contained through storm sewers and dry wells, many agencies at all levels of the government are paying increased attention to both the contaminants that enter the water system through surface water run-off, and to methods to control and eliminate such contaminants. Moreover, governmental regulations currently in place put restrictions on the amount of sediment that can be permitted to flow into sewer systems.

A municipal storm sewer system is one type of traditional surface water filtering system. In this type of system a series of grated catch basins or collection boxes are interconnected with sewer pipe. Surface water flows through the grate, which catches large objects such as branches, rocks and the like. The water that flows through the grate enters the catch basin, which is a collection box or vault that functions essentially as a settling basin. Such collection boxes are sometimes called sump tanks. Some sediment that flows through the grate settles to the bottom of the basin, and the water flows through an outlet pipe and into the sewer system and, depending upon the system, either to another processing facility or directly into a stream or river.

This traditional system is useful as a primary control system, and is relatively inexpensive, but it has many problems. As examples of the problems, the catch basin can quickly be filled with sediment if the water contains a high level of solids or sediment, causing the catch basin to become filled and the system to overflow or become clogged. Because the catch basin is typically a cylindrical tube or a rectangular box that sits below grade level, cleaning the sediment out of the basin can be a difficult job. Cleaning is made much more difficult if the system is clogged and the basin is underwater. Just as important, the system does not stop all of the sediment and other pollutants in the run-off. Typically, the water flow through the basin is fairly turbulent, especially when there is a lot of water flowing through the system, for instance during a storm. When this occurs very little sediment settles out, and is instead washed through the basin and into the sewer system. This may result in non-compliance with governmental regulations, possibly resulting in fines. Finally, a typical catch basin system does nothing to collect oils and other chemical contaminants and dissolved solids.

The grated catch basin type of system is routinely used with both private and municipal dry wells. In a dry well the surface water that flows through the sump tanks flows into a dry well associated with one or more basins rather than flowing into a municipal or other sewer system. However, to function properly, dry wells must have sufficient flow-through characteristics. Water containing a high level of sediment can quickly clog a dry well by stopping water flow-through. And as noted above, a grated catch basin does not stop oils and other chemicals. These kinds of pollutants, and especially oils that flow through the system can clog dry wells very quickly. Commercial dry wells can be very large, especially if they are used to contain run-off from a large area such as a large private parking lot, and are connected to numerous catch basins. It is typically very expensive to dig a new dry well, or to unclog an existing well.

As noted, many government agencies are paying increased attention to contaminants that are carried into streams and rivers in surface water run-off. Because polluted surface water run-off can be a significant source of pollution, agencies have begun to monitor the levels of contaminants in run-off, both in municipal and private systems. In the past several years, many municipalities have begun to impose fees on catch basin users, whether the catch basin is connected to a storm sewer system or a dry well. While these fees apply in most instances to commercial users, they can also apply to residential systems. In large part the fees are based in some manner on the kind and amount of pollutants that flow through the catch basin and into the system. In general, the higher the level of contaminants flowing through the system, the higher the fee. In some cases the amount of the fee is based on the kind of contaminant. For example, oils flowing into a sewer or dry well can lead to increased fees. These fees even apply to private commercial dry well users, since it is in the interest of a municipality to control the amount of pollution that enters the ground water.

There is therefore a strong incentive to decreasing both the amount and kind of contaminants flowing through a catch basin and into either a municipal sewer system or a private dry well or sewer system. First, there is an obvious environmental incentive: by decreasing contamination of all kinds from surface water run-off, the water that flows back into the ground and into streams and rivers is cleaner. This helps to improve environmental conditions in numerous ways. Second, there is a strong economic incentive: when sewer system and dry well users are paying fees based on the amount and kind of contaminants that flow into their systems, it is of obvious advantage to minimize all contaminants. Further, the costs associated with either cleaning catch basins or reconditioning dry wells are substantial. Avoiding or delaying those costs by reducing the amount of contaminants flowing through the system can save substantial amounts of money.

Given the need to effectively filter debris and contaminants from surface water run-off, various catch basins and other filter systems have been devise. As one example, U.S. Pat. No. 5,284,580 describes a collecting frame for use with a drainage sewer. The system utilizes a basin that fits into the sewer drain and is removable therefrom. The basin has a filtering net for trapping debris that flows into the basin through a sewer cover. An imperforate collecting basin catches particulate matter while tiny particles flow through the system with the run-off water. While this device filters out some particulate matter, it does not stop small particles or oils from entering the sewer system.

Another example of a surface water filter system is disclosed in U.S. Pat. No. 5,405,539. The system disclosed in the '539 patent is inserted into an existing storm drain collection box. A frame supports a sheet of filter medium, such as a woven synthetic material that removes particles as small as 42 microns in diameter. Pneumatic rams hold the filter material and frame in place in the collection box. Silt and other particulate debris collects on the filter compartment until the woven filter is clogged and/or the filter compartment is full, at which time excess drainage water overflows, unfiltered, over the back of the filter drain and into the sewer system. The woven filter is replaced by removing the spent sheet from the collection box and replacing it with fresh material.

Yet another filter system is disclosed in U.S. Pat. No. 5,372,714. This system is adapted for use with buried, below grade catch basins, and utilizes a filter bag made of a woven plastic fabric that is porous, but which captures solids. The filter bag hangs into the catch basin, supported by the overlying grate. When full, the bag is removed by inserting lifting rods into loops of fabric connected to the bag.

Still another example is disclosed in U.S. Pat. No. 6,200,484, which describes a filter system that is installed in preexisting catch basins. The system in the '484 patent describes primary, secondary and tertiary filter components. However, the system of the '484 patent requires a catch basin insert, and the tertiary filter has a relatively low surface area considering the volume of the catch basin insert.

Despite the improvements that have been made as exemplified by the foregoing patents, none of the systems described in these patents provides for a simple, easily maintained filter system that screens out solids and selected other contaminants such as oils and other petrochemicals, or other liquid contaminants and chemicals, and there is a need for such a system.

SUMMARY

The surface water run-off filter of the present invention is designed to adapt to existing sewer systems and dry well systems that utilize either preexisting sump tanks or catch basins, or stand alone catch basins or tanks. The catch basins may be either in-ground, or above-the-ground, depending upon the type of installation. The apparatus utilizes a primary, secondary and tertiary filter system. Run-off flowing into the system preferably must pass through each of the three filters. The first filter is the traditional grate that overlies the inlet to the catch basin. This filter catches large solid particles such as rocks, branches and the like. A removable plate or lid underlies the grate and directs water flow into a secondary filter that is a cylindrical perforate screen that has an open upper end and a perforate screen on the lower end; this filter traps solids that flow past the grate. The screen is rigid or semi-rigid and when used supports the tertiary filter. A cylindrical filter surrounds the perforate screen on the sides and bottom and the water passes through this tertiary filter. The tertiary filter comprises a non-woven sediment filter that optionally includes media contained in the filter. When media is incorporated into the tertiary filter, the media selected for this tertiary filter depends upon the conditions encountered at a specific location. The media may be specific to absorb oils and petrochemicals, as might be expected in run-off from parking lots. Similarly, oils are often contained in run-off from food processing facilities. The present invention contemplates the use of other types of media for removing other contaminants. Thus, other kinds of filter media that can be used are media specifically designed for filtering out carbohydrates and media designed for binding aid thus removing metals. This type of media is used with, for example, catch basins that collect water that has been used as process water in food processing facilities. By filtering out carbohydrates, the facility may be able to reduce the BOD of the water, thereby reducing municipal fees. The screen that defines the secondary filter is typically utilized, but it will be appreciated that the tertiary filter may be used without the secondary filter and the system is functional without the secondary screen.

The system of the present invention is easily cleaned and maintained, and each component may be separately interchanged when appropriate. For example, the secondary and tertiary filters are easily removed from the basin insert for removal and replacement of the tertiary filter. If upon visual inspection it is evident that the tertiary media needs replacing, the service personnel can replace the media in a matter of minutes. Similarly, the secondary screen can be easily removed from the system and either dumped and cleaned, or replaced if the perforations are clogged. Finally, the entire insert may be removed from the existing catch basin if needed for cleaning or maintenance.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION

Figure 1:
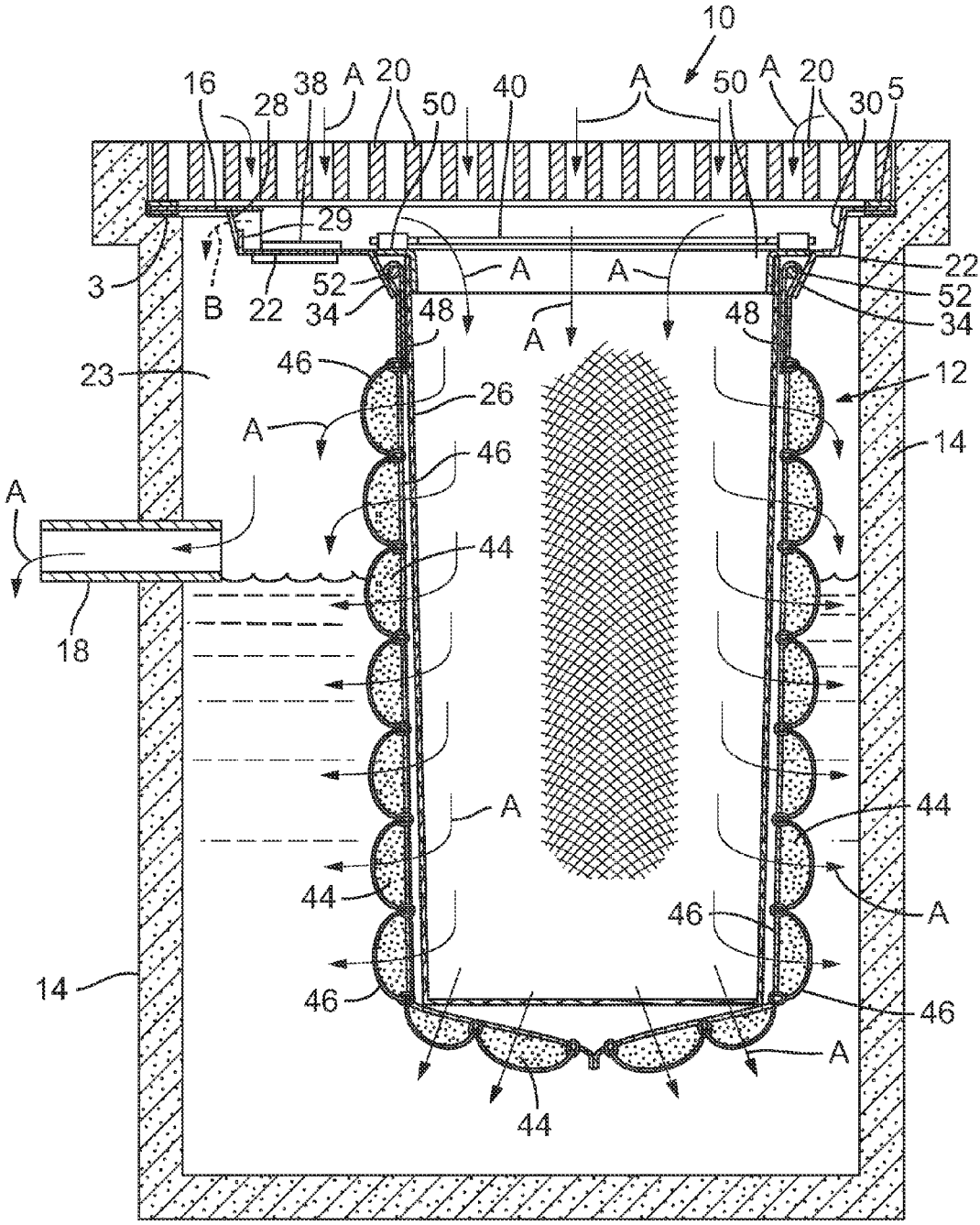
FIG. 1 is a side sectional view of a catch basin with the filtration system of the present invention inserted therein.

A filtration apparatus 10 according to the present invention is shown in cross section in FIG. 1. The apparatus includes a catch basin insert shown generally at 12 that that has an upper plate 22 that is shaped to fit into an existing pre cast catch basin 14 or, as detailed below, into a stand alone basin or tank. In the case where the catch basin 14 is installed in the ground, the upper edge of the catch basin is typically at grade level so that surface water readily flows into apparatus. Catch basin insert 12 may be essentially any shape corresponding to the shape of the catch basin 14 into which the insert is inserted. As noted, catch basin 12 is designed for installation into existing catch basins. Thus, the apparatus of the present invention can be installed into existing sewer and dry well systems very easily.

Most catch basins are either round or rectangular, and so in most instances the upper plate 22 of catch basin insert 12 will be of a corresponding shape. Upper plate 22 is designed to drop into the pre cast catch basin 14. The plate is readily removable from catch basin 14 for cleaning and other maintenance. Upper plate 22 has a peripheral shoulder 16 that rests on a preformed peripheral shoulder 3 of catch basin 14. Preferably, a strip of sealing material 5 extends around the periphery of upper plate 22. An outflow pipe 18 defines the outflow path for water flowing out of catch basin 14. A conventional grate 20 rests on shoulder 16 with the upper surface of the grate at about grade level. Grate 20 is removable and functions as a primary filter for relatively larger solid debris and other objects flowing into the system. Outflow pipe 18 is shown in FIG. 1 located in a typical position in one type of catch basin. However, other types of catch basins have the outflow pipe in other locations.

Figure 2:
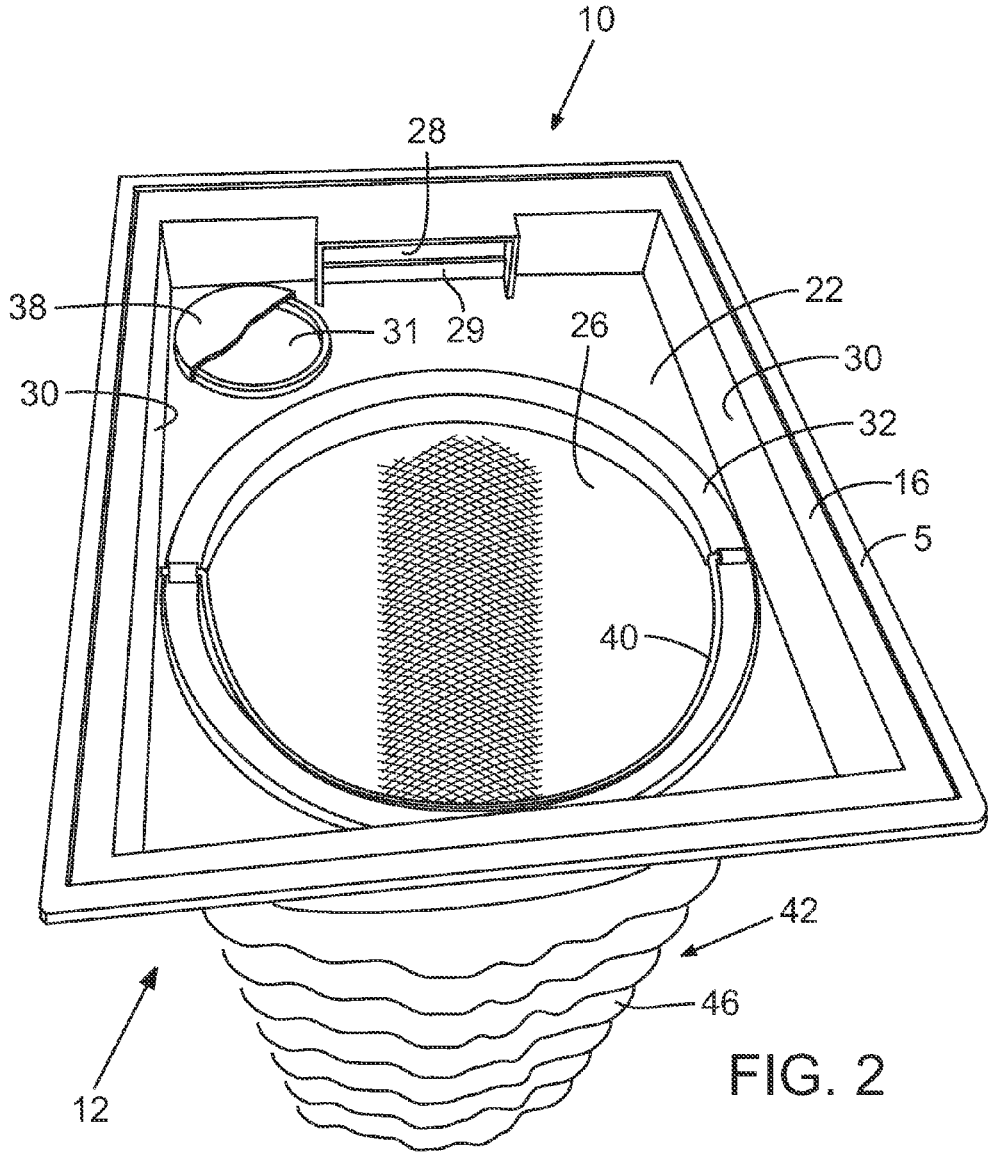
FIG. 2 is a top perspective view of the filtration system of the present invention.

Upper plate 22 is sized to fit within and rest on shoulder 16 and is readily removable therefrom. When positioned as shown in FIG. 1, plate 22 defines a lid covering the inlet opening into the catch basin insert, thereby defining an interior space 23 under the lid and within catch basin 14. Plate 22 has a round opening 24 into which secondary filter strainer 26 is inserted and on which the strainer is supported and suspended. A downwardly extending and inwardly sloping shoulder 34 extends from plate 22 around the periphery of opening 24, and as detailed below, serves as an attachment for attaching the tertiary filter to plate 22, and suspending the tertiary filter from the plate. Plate 22 further has an overflow opening 28 that may best be seen in FIG. 1. Overflow opening 28 preferably includes a dam or weir 29 and may be louvered if desired, and comprises a slot in the upper plate 22 formed in a tapered edge collar portion 30. As detailed more thoroughly below, overflow opening 28 is positioned in upper plate 22 such that the flow path of water normally flows into the secondary filter strainer 26 and into the downstream portions of the system—the weir prevents water from flowing into the overflow opening unless an overflow condition is present. However, if the downstream filters are clogged or if for another reason the volume of water flowing into the system exceeds the capacity of the system, the overflow 28 functions as an overflow vent that allows the flow path to bypass the downstream filters. Finally, upper plate 22 includes an access port 31 that includes a removable cover 38 (FIG. 2) that preferably forms a water tight seal. The access port allows for easy sampling of water that has passed through the filter system so that it may be tested to determine the quality of the water after it has been filtered.

Filter strainer 26 comprises a cylindrical mesh sleeve having an upper peripheral lip 32 that is smaller than the diameter of the opening 24 in plate 22. When strainer 26 is fitted into opening 24 as shown in FIG. 1, lip 32 rests on the inwardly sloping shoulder 34 so that the upper surface of the lip is flush with the upper surface of plate 22 and, as detailed below, just above or on the upper margin of the tertiary filter such that the strainer 26 is suspended into the space 23 under the upper plate 22, supported and held in place by the plate. Strainer 26 has a downwardly extending cylindrical side wall that extends into the interior space 23 below plate 22 such that the closed bottom of the strainer, which may be mesh or solid, is spaced apart from the bottom of the catch basin 14. Filter strainer 26 is a perforate mesh screen that has plural openings 41 sized to filter out solid debris that flows through a grate 20. Gate 20 is removable and functions as a primary filter for relatively larger solid debris and other objects flowing into the system. Preferably, the side wall of strainer 26 tapers from the lip 32 toward the bottom.

Strainer 26 is preferably cylindrical but can be of any shape. The size of the perforate openings 41 in the screen can be varied to accommodate conditions at any given site where apparatus 10 is located. As an example, if the site has a relatively large amount of small solid objects such as small rocks flowing into the system, a filter strainer 26 having perforate openings of an appropriate size can be selected and used. To facilitate easy removal of filter strainer 26 from its position in plate 22, a handle 40 is provided. Because the strainer of the preferred embodiment is cylindrical it has substantial surface area to volume ratio and thus has substantial filtering capacity. It can thus be used to filter out a substantial amount of debris before it becomes full or clogged. As particulate matter accumulates within the strainer the basket fills from the bottom toward the top. Water is still able to flow freely through the basket until it is completely full.

As noted previously, strainer 26 is typically used with filtration apparatus 10. However, the tertiary filter 42 described below is self-supporting and the apparatus 10 is fully functional without the strainer 26. As such, the strainer 26 is optional.

Figure 4:
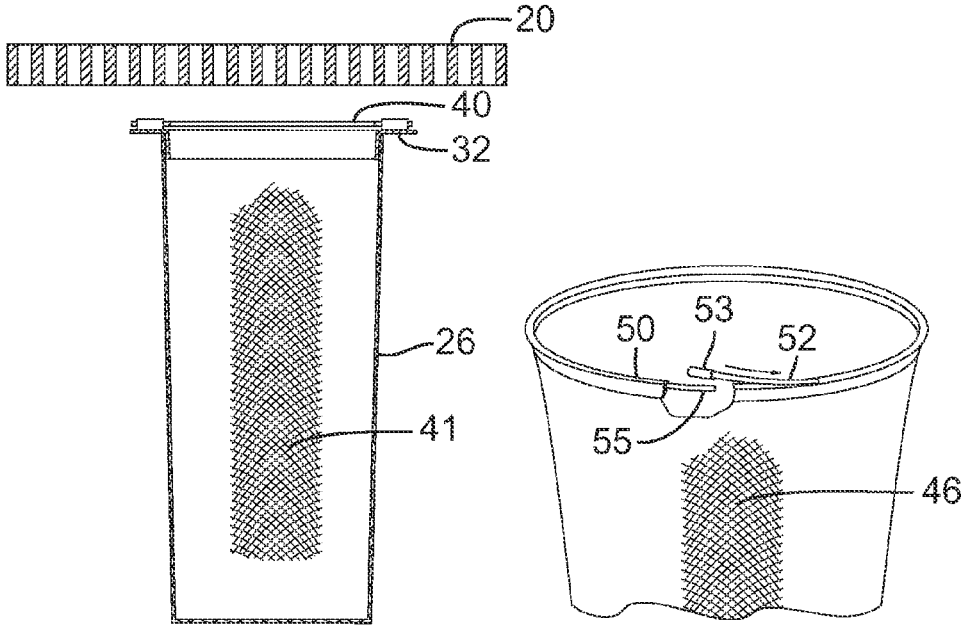
FIG. 4 is a perspective and isolated view of the upper portion of one component of the filtration system.
Figure 3:
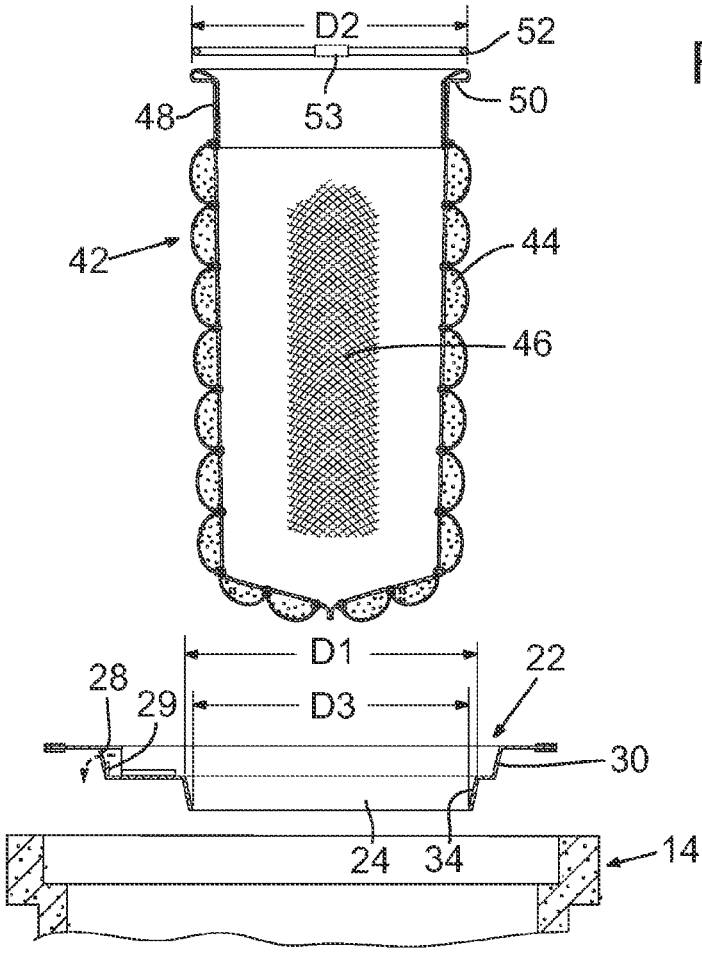
FIG. 3 is an exploded view of the components of the filtration system of the present invention in which some of the components are shown in section.

A tertiary filter 42 is located interiorly in space 23 and substantially completely surrounds the exterior surface of strainer 26 below plate 22. As shown herein tertiary filter 42 preferably comprises a filter media 44 that is sandwiched between and supported by inner and outer layers of a mesh fabric material 46 that in the illustrated embodiment is formed into tubes that encircle the outer walls of the strainer and also the lower bottom of the strainer to substantially enclose the strainer. As such, as best seen in FIG. 1, the tertiary filter 42 completely encloses the secondary strainer 26. The mesh fabric material 46 is preferably a flexible material that is capable of containing the filter media 44 and through which water readily flows—there are many types of non-woven and woven fabric mesh products that suffice. Preferably, a strip of relatively stronger material such as vinyl strip 48 is sewn to the fabric material 46 around the upper edge of the fabric material to provide a more secure attachment point. With reference to FIG. 4, the vinyl strip 48 includes a circumferential loop 50 sewn therein at the upper edge thereof and a ring 52 such as a flexible split metal ring is captured in the loop 50. A sleeve 53 is attached to one end of the split metal ring 52—the opposite end 55 of the ring is slidable into and out of the sleeve 53. When the end 55 is inserted into sleeve 53 the ends of the ring abut one another, fixing the diameter of the ring. As noted previously, a downwardly and inwardly sloped shoulder 34 extends around opening 24 of upper plate 22. The diameter of metal ring 52 when the end 55 of the ring is inserted into the sleeve 53 is greater than the diameter of opening 24 measured at the lowermost extent of shoulder 34, but smaller than the diameter of opening 24 measured at the uppermost extent of the shoulder 34. Tertiary filler 42 is attached to upper plate 22 by placing the metal ring 52 within shoulder 34 as shown in FIG. 1—since the diameter of ring 52 is less than the diameter of opening 24 at the uppermost point of shoulder 34 yet greater than the diameter of the opening at the lowermost point of the inwardly sloping shoulder and because the diameter of the ring cannot be made smaller once the end 55 is inserted in sleeve 53, the metal ring defines a locking ring that holds the tertiary filter 42 firmly in place with the filter suspended below the upper plate 22.

As an alternative embodiment, the diameter of metal ring 52 may be fixed with the two opposite ends of the ring fixed to one another.

The relationship in the diameters of shoulder 34 in relation to metal ring 52 is best seen in the exploded view of FIG. 4 where it may be seen that the dimension represented with D1 is the diameter of opening 24 at the uppermost portion of shoulder 34. The dimension D3 is the diameter of opening 24 and its narrowest point, which is the diameter of opening 24 at the lowermost extend of shoulder 34. Dimension D2, which is the diameter of metal ring 52 (measured at the outside of the ring material) is between D1 and D3. As such, since the diameter of metal ring 52 cannot be reduced when end 55 is inserted into sleeve 53, the metal ring and thus the attached tertiary filter 42 are securely suspended on plate 22. It will also be evident that the tertiary filter may be attached to plate 22 from the bottom-up (by opening the metal ring, moving the opened ring from the bottom of opening 24 into position relative to the plate and then securing the ring), or from the top down (with the metal ring secured).

Although in the figures the tertiary filter 42 is shown as a single layer construction, multiple layers of the fabric material 46 and filter media 44 may be utilized. It will further be understood that the filter media 44 may be captured and held between the layers of fabric in structures other than the tubes illustrated herein. Finally, those of skill in the art will recognize that there are numerous equivalent structures that allow the tertiary filter to be attached to the plate.

Media 44 is preferably a filter medium that includes sorbents selected to filter out contaminants that are desirably removed in any given situation. As such, the particular media that is used a given system will depend upon the kinds of contaminants that are found in that system. For example, in many systems it is desirable to eliminate oils and other petrochemicals from the system. This is true with run-off from parking lots and the like since oil from automobiles is a substantial pollutant and, in dry wells, can cause clogging and other inefficiencies. An example, media 44 may be selected for its inclusion of sorbents specifically selected to absorb oil and other petrochemicals. While filter media selective for petrochemical filtering is one type of filter media 44 used with the present invention, other contaminant-specific filter media may be substituted. As another example, sorbents may be selected for the ability to bind heavy metals or target organic molecules. Filter media 44 thus may be any media selected as a tertiary filter media for filtering out selected contaminants that flow through the primary filter, grate 20, and the secondary filter, strainer 26.

Since tertiary filter 42 typically is not a ser-supporting structure, the secondary strainer 26 fits into the central portion of the tertiary filter as shown in FIG. 1. Because the secondary strainer 26 is a rigid or semi-rigid structure, it provides a support for the tertiary filter 42. Also, because the tertiary filter 42 is cylindrical, it provides greater surface area through which water may flow than a planar filter and greater through-flow capacity. It will be appreciated that tertiary filter 42 may also omit the media 44 and may thus comprise only the fabric material 46.

To assemble apparatus 10, plate 22 is first placed into catch basin 14 as described above. Tertiary filter 42 is then inserted through opening 24 and attached to shoulder 34 with ring 52 so that the tertiary filter is suspended in the space 23 between plate 22 and the interior walls of the catch basin. It will be noted that the ring 52 may be disconnected with end 55 removed from sleeve 53 so that the tertiary filter may be attached to shoulder 34 either from the bottom-up, or from the top down. In either case, once the tertiary filter is in place relative to opening 24 and shoulder 34, the end 55 is inserted into sleeve 53. Next, the secondary filter defined by filter screen 26 is inserted into the interior of tertiary filter 42 until lip 32 rests in the recessed area formed in plate 22, with the lower surface of lip 32 abutting the upper peripheral edge of the tertiary filter 42, as best seen in FIG. 1. The grate 20 may then be installed over the apparatus as shown.

System 10 is designed so that under normal conditions where none of the three filters is clogged or otherwise not functioning properly, all run-off water flowing into the system flows sequentially through each of the three filters. Thus, the flow path in normal conditions is, sequentially, through grate 20, into and through strainer 26 and then through tertiary filter 42 before passing out of outflow pipe 18. Each of the filters removes successively smaller particles, or as noted, targeted molecules or compounds. Grate 20 stops relatively larger solid objects such as rocks and branches from entering the system. The size of openings in filter strainer 26 may be varied to accommodate conditions in a given setting. However, filter strainer 26 will in all instances remove relatively smaller solid objects than grate 20. Tertiary filter 42, while being selected according to the filtering specificity required in a particular use condition, filters out either relatively smaller suspended particles than filter strainer 26, or liquids such as oils, depending upon the type of media 44.

In normal conditions with the three filters functioning properly the water flow path is shown with arrows A in FIG. 1. As such, under normal conditions water does not flow through overflow 28. However, when the volume flowing into system 10 exceeds the through-flow capacity of the system, or when either strainer 26 or tertiary filter 42 is clogged, excess water flows into overflow 28 and thus into space 23 without exposure to either the secondary or tertiary filters. Overflow 28 thus defines a second state water flow path (arrow B) for the situation where one or both of the secondary and tertiary filters is clogged or when the volume of inflow exceeds the through-flow capacity.

The filter system uses components that are easily removed, cleaned and serviced in the field. For example, grate 20 may be removed to allow filter strainer 26 to be cleaned, either by removing the strainer and dumping its contents of collected debris, or by other cleaning techniques such as vacuum cleaning. Similarly, strainer 26 is easily removed to allow for easy removal and replacement of tertiary filter 42. When the media 44 in tertiary filter 42 has absorbed its capacity of oil or other contaminant is clogged or for some other reason requires replacing, the filter 42 can be removed by first removing strainer 26, then releasing ring 52 and removing the tertiary filter upwardly through opening 24 or by pushing the tertiary filter downwardly into the space beneath plate 22. The ring 52 thus acts as a retaining clip that maintains the tertiary filter in position with respect to opening 24.

It will be appreciated that the apparatus 10 described above may also be adapted to function with sump tanks other than in-ground vaults such as those described above. For example, an above-ground vault having a construction similar to the in-ground vault 14 may incorporate a filtration apparatus 10 according to the present invention—the source of the surface water flowing into the apparatus may be from a downspout and the like. The catch basin with which the apparatus 10 is thus used need not be a pre-existing in-ground vault, but instead may be fabricated for use with apparatus 10 in an above-grade setting.

While the present invention has been described in terms of a preferred embodiment, it will be appreciated by one of ordinary skill that the spirit and scope of the invention is not limited to those embodiments, but extend to the various modifications and equivalents as defined in the appended claims.

What is claimed is:

1. A surface water filtration apparatus for use with a catch basin connected to an outflow, comprising:

a removable plate configured for insertion into said catch basin and for being retained therein to define a catch basin interior beneath said removable plate, said plate having first opening therethrough and a second opening therethrough with a removable cover for selectively opening a closing said second opening;

a removable grate defining a primary water filter;

a perforate strainer extending through said first opening through said plate and into said catch basin interior, said perforate strainer having an open upper end, mesh side walls and an imperforate closed lower end and said strainer defining a secondary water filter;

a tertiary water filter extending into said catch basin interior such that said tertiary water filter surrounds said perforate strainer, said tertiary water filter comprising mesh fabric material for filtering contaminants passing through said primary and said secondary water filters between said inner and outer layers of mesh fabric material;

wherein said water filtration apparatus defines a first water flow path through said primary, secondary and tertiary filters and wherein said second opening through said removable plate defines an access port to water that has flowed through said primary, secondary and tertiary filters.

2. The surface water filtration apparatus according to claim 1 wherein the opening through said plate is further defined by a downwardly and inwardly sloping shoulder that defines a first upper diameter and a second, smaller diameter at a lower edge of the shoulder, and wherein the perforate strainer comprises a cylindrical member having rigid or semi-rigid mesh material side walls and a solid bottom surface.

3. The surface water filtration apparatus according to claim 2 in which the tertiary water filter is defined by a cylindrical member having an open upper end and a closed bottom end.

4. The surface water filtration apparatus according to claim 3 wherein said tertiary water filter includes a ring extending around the upper open end and said ring defines a diameter that is greater than said second diameter and smaller than said first diameter.

5. The surface water filtration apparatus according to claim 4 in which the ring is split and has a sleeve attached to one end, the opposite end of the ring being insertable into the sleeve such that when the opposite end of the ring is inserted into the sleeve the diameter of the ring is fixed.

6. The surface water filtration apparatus according to claim 1 wherein the catch basin is defined by an in-ground vault.

7. The surface water filtration apparatus according to claim 1 including a seal strip extending around a periphery of the removable plate to form a seal between the removable plate and the catch basin.

8. The surface water filtration apparatus of claim 1 wherein said apparatus defines a second water flow path in which water in the second flow path does not pass through the secondary or tertiary water filters, said second water flow path is defined by an overflow opening in an upwardly extending portion of the removable plate such that said overflow opening is above the level of the removable plate.

9. The surface water filtration apparatus of claim 8 wherein the overflow opening defines a weir.

10. The surface water filtration apparatus according to claim 1 wherein the perforate strainer includes a handle attached thereto.

11. In a catch basin for collection of run-off water, said catch basin having a water holding vault, an inlet opening into said vault with a removable grate covering said inlet for removing relatively large objects from run-off water, and an outlet through which run-off water flowing into said vault exits into a sewer or dry well, the catch basin defining a water flow path from the water source through the grate and into the water holding vault, and through the outlet and into a sewer or dry well, the improvement comprising:

a grate defining a first filter;

a plate retained in the catch basin below the grate, said plate having a circular opening therethrough and said plate defining an enclosed area in the water holding vault below said plate, and an inwardly and downwardly sloping shoulder extending around said circular opening;

a second filter interposed in the flow path between said grate and said outlet opening such that water flowing into said opening flows through said second filter, said second filter adapted for filtering relatively smaller particulate debris than said grate and said second filter defined by an enclosed cylindrical rigid or semi-rigid tube extending into the enclosed area below said plate and said tube having mesh side walls and an imperforate bottom wall;

a third filter interposed in the flow path between said second filter and said outlet opening, said third filter adapted for filtering relatively smaller debris than said second filter and said third filter substantially surrounding the mesh material below said plate and wherein said third filter is suspended from said plate.

12. The apparatus according to claim 11 wherein the second filter is supported by and removable from said plate.

13. The apparatus according to claim 12 wherein said third filter is has a fixed-diameter cylindrical ring member at an open upper end thereof that is adapted for suspending the third filter from the inwardly and downwardly sloping shoulder.

14. The apparatus according to claim 13 wherein opening in the plate defines a first diameter and a second, smaller diameter at a lowermost edge of the inwardly and downwardly sloping shoulder, and wherein diameter of the fixed-diameter ring is between the first diameter and the second diameter.

15. A method of removing contaminants from run-off water, comprising the steps of:

(a) inserting into a catch basin a plate to define an insert space beneath said plate, and said plate having a first opening therethrough and a second opening therethrough, the second opening having a removable cover for selectively opening and closing said second opening;

(b) suspending from the plate and through the first opening a flexible filter comprising media selected for the ability to filter components from the run-off water as water flows through said flexible filter and such that the flexible filter is suspended in the insert space below said plate, said flexible filter defining a body having central opening at an upper end, sides and a bottom; and (c) inserting a rigid or semi-rigid strainer having a closed bottom surface into the central opening of said flexible filter, so that said flexible filter conforms to an outer surface of said strainer.

16. The method of claim 15 whereby said steps (a) through (c) define a first water flow path in which run-off water flowing into said catch basin flows, sequentially, through said grate, through said strainer, through said filter, and wherein said run-off water flows out of said catch basin through a catch basin outlet.

17. The method of claim 16 including the step of including filter media with the filter and selecting the filter media according to impurities desired to be removed from said water.

18. The method of claim 15 including the step of defining a second water flow path in which run-off water flows through said grate and through the catch basin outlet but does not flow through said strainer or said flexible filter.

19. The method of claim 18 including the step of attaching the filter to the plate with a fixed diameter ring.

* * * * *